US009027265B1

(12) United States Patent
Mueller et al.

(10) Patent No.: US 9,027,265 B1
(45) Date of Patent: May 12, 2015

(54) ZERO HORIZONTAL REACTION FORCE EXCAVATOR

(71) Applicant: The United States of America as Represented by the Administrator of the National Aeronautics and Space Administration, Washington, DC (US)

(72) Inventors: Robert P. Mueller, Cocoa Beach, FL (US); Andrew J. Nick, Cocoa, FL (US); Jason M. Schuler, Rockledge, FL (US); Jonathan D. Smith, Titusville, FL (US)

(73) Assignee: The United States of America as Represented by the Administrator of the National Aeronautics and Space Administration, Washington, DC (US)

( * ) Notice: Subject to any disclaimer, the term of this patent is extended or adjusted under 35 U.S.C. 154(b) by 74 days.

(21) Appl. No.: 13/896,896

(22) Filed: May 17, 2013

Related U.S. Application Data

(60) Provisional application No. 61/649,008, filed on May 18, 2012.

(51) Int. Cl.
*E02F 3/32* (2006.01)
*E02F 5/00* (2006.01)
*E02F 3/18* (2006.01)

(52) U.S. Cl.
CPC .. *E02F 5/00* (2013.01); *E02F 3/188* (2013.01)

(58) Field of Classification Search
USPC ..... 37/443, 353, 91, 95, 189, 190, 329, 92, 37/93, 462; 405/164, 179; 299/7, 17, 67; 198/304, 316.1, 508, 585, 506, 509; 414/133
See application file for complete search history.

(56) References Cited

U.S. PATENT DOCUMENTS

| | | | | |
|---|---|---|---|---|
| 3,746,150 | A * | 7/1973 | Briggs | 198/304 |
| 4,560,019 | A | 12/1985 | Barber | |
| 6,085,445 | A * | 7/2000 | Kanzler | 37/222 |
| 7,114,271 | B2 * | 10/2006 | Chagnot et al. | 37/352 |
| 7,363,733 | B2 * | 4/2008 | Stoetzer | 37/189 |
| 7,549,240 | B2 * | 6/2009 | Casagrande | 37/91 |
| 7,637,038 | B2 * | 12/2009 | Arzberger et al. | 37/91 |

OTHER PUBLICATIONS

D. Larry Clark et al., "A Novel Approach to Planetary Regolith Collection: the Bucket Drum Soil Excavator," American Institute of Aeronautics and Astronautics SPACE 2009 Conference and Exposition, AIAA 2009-6430, Sep. 14, 2009.

* cited by examiner

*Primary Examiner* — Robert Pezzuto
(74) *Attorney, Agent, or Firm* — Michelle L. Ford; Peter J. Van Bergen

(57) ABSTRACT

An excavator includes a mobile chassis with a first bucket drum and a second bucket drum coupled thereto. The first bucket drum and second bucket drum are coupled to the chassis for positioning thereof on the surface at opposing ends of the chassis. Each first scoop on the first bucket drum is a mirror image of one second scoop on the second bucket drum when (i) the first bucket drum and second bucket drum are on the surface adjacent opposing ends of the chassis, and (ii) the first bucket drum is rotated in one direction and the second bucket drum is simultaneously rotated in an opposing direction.

29 Claims, 7 Drawing Sheets

ZERO HORIZONTAL REACTION FORCE EXCAVATOR

CROSS-REFERENCE TO RELATED APPLICATIONS

This application claims the benefit under 35 U.S.C. §119 (e) of U.S. Provisional Patent Application Ser. No. 61/649,008 filed May 18, 2012, the contents of which are incorporated herein by reference.

ORIGIN OF THE INVENTION

The invention described herein was made in the performance of work under a NASA contract and by an employee of the United States Government and is subject to the provisions of Public Law 96-517 (35 U.S.C. §202) and may be manufactured and used by or for the Government for governmental purposes without the payment of any royalties thereon or therefore. In accordance with 35 U.S.C. §202, the contractor elected not to retain title.

BACKGROUND OF THE INVENTION

This invention relates to excavators. More specifically, the invention is an excavator that generates zero horizontal reaction force when excavating a surface region.

Lunar soil/regolith excavation is considered a vital requirement for future space missions to the Moon and other extra-terrestrial bodies such as Mars, asteroids, or even comets. The regolith is necessary for purposes of In-Situ Resource Utilization (ISRU) in order to create needed commodities such as propellants, breathable air, buffer gases, water for plant growth, portable drinking water for life support, manufacturing, and science as well as to pursue civil engineering construction such as landing pads, berms, roads, surface stabilization for dust control and thermal heat sinks, foundations, structures, habitats, and micro-meteorite/radiation shielding. The excavation of regolith is extremely difficult because deeper regolith (i.e., at depths of 30 cm and more) has bulk densities as high as 1.8 grams/cm$^3$. Specifically, the very small regolith grain particles (e.g., 0-100 microns) exhibit strong cohesion due to electrostatic forces, van der Waals forces, and interlocking morphology.

In addition to the problems associated with regolith density, the low weight in space surface environments (e.g., the Moon's gravity is $1/6^{th}$ that of the Earth) means that the mass of the excavator vehicle is of little or no value in terms of generating a reaction force for the excavator blade and scoop. That is, the excavator's blade and scoop cannot penetrate the regolith using conventional excavation techniques. In comparison, Earth-based excavators can utilize a brute force solution simply by making the excavator heavy to thereby create the desired reaction force. Due to the current high costs of lifting goods into space (i.e., approximately $4,000/kilogram), as well as packaging and launch vehicle shroud volume constraints, regolith excavation machines designed for use on extra-terrestrial bodies must necessarily be both small and lightweight. Accordingly, conventionally-designed excavation machines are not suitable options for in-space applications.

SUMMARY OF THE INVENTION

Accordingly, it is an object of the present invention to provide an excavator for use in low-gravity environments.

Another object of the present invention is to provide an excavator that is small and lightweight.

Still another object of the present invention is to provide an excavator for regolith excavation on extra-terrestrial bodies.

Other objects and advantages of the present invention will become more obvious hereinafter in the specification and drawings.

In accordance with the present invention, an excavator includes a mobile chassis, a first bucket drum, and a second bucket drum. The first bucket drum has a first axis of rotation and is coupled to the chassis. The first bucket drum has at least one first scoop formed thereon that is adapted to dig into a surface when the first bucket drum is placed on the surface and is rotated about its first axis of rotation in a first direction. The second bucket drum has a second axis of rotation and is coupled to the chassis. The second bucket drum has at least one second scoop formed thereon that is adapted to dig into the surface when the second bucket drum is placed on the surface and is rotated about its second axis of rotation in a second direction that is opposite to the first direction. The first bucket drum and second bucket drum are coupled to the chassis for positioning thereof on the surface at opposing ends of the chassis. Each first scoop on the first bucket drum is a mirror image of one second scoop on the second bucket drum when (i) the first bucket drum and second bucket drum are on the surface adjacent opposing ends of the chassis, and (ii) the first bucket drum is rotated in the first direction and the second bucket drum is simultaneously rotated in the second direction.

BRIEF DESCRIPTION OF THE DRAWINGS

Other objects, features, and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
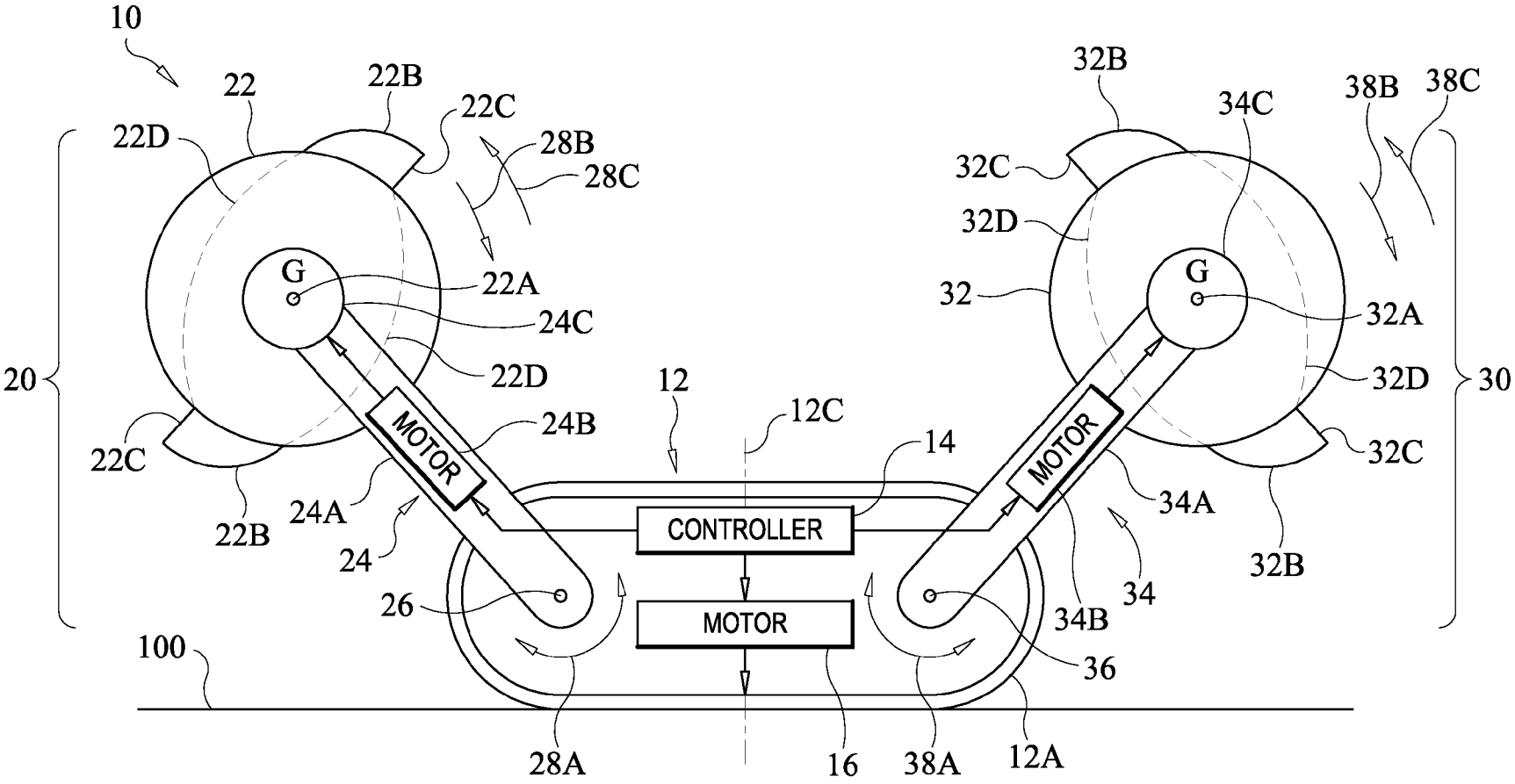
FIG. 1 is a side schematic view of a zero reaction force excavator in a transport position in accordance with an embodiment of the present invention.
Figure 2:
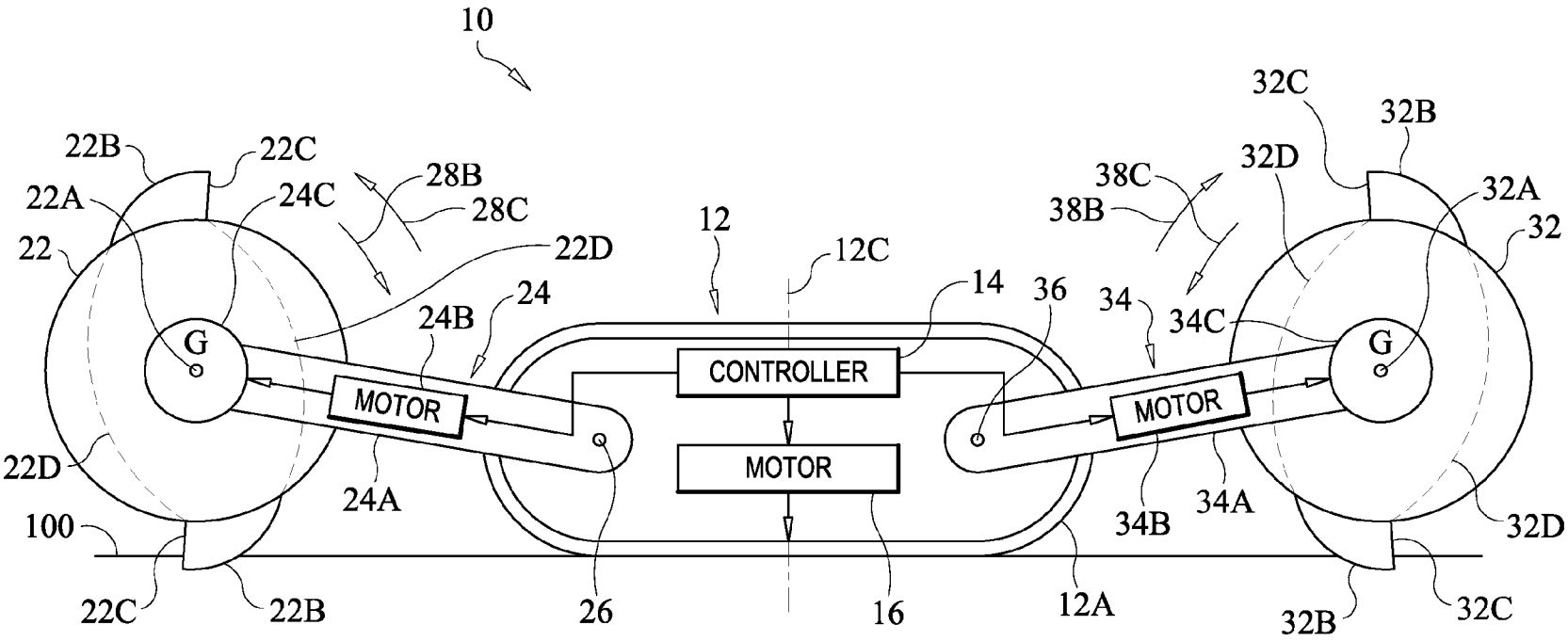
FIG. 2 is a side schematic view of the zero reaction force excavator in its excavation position.
Figure 3:
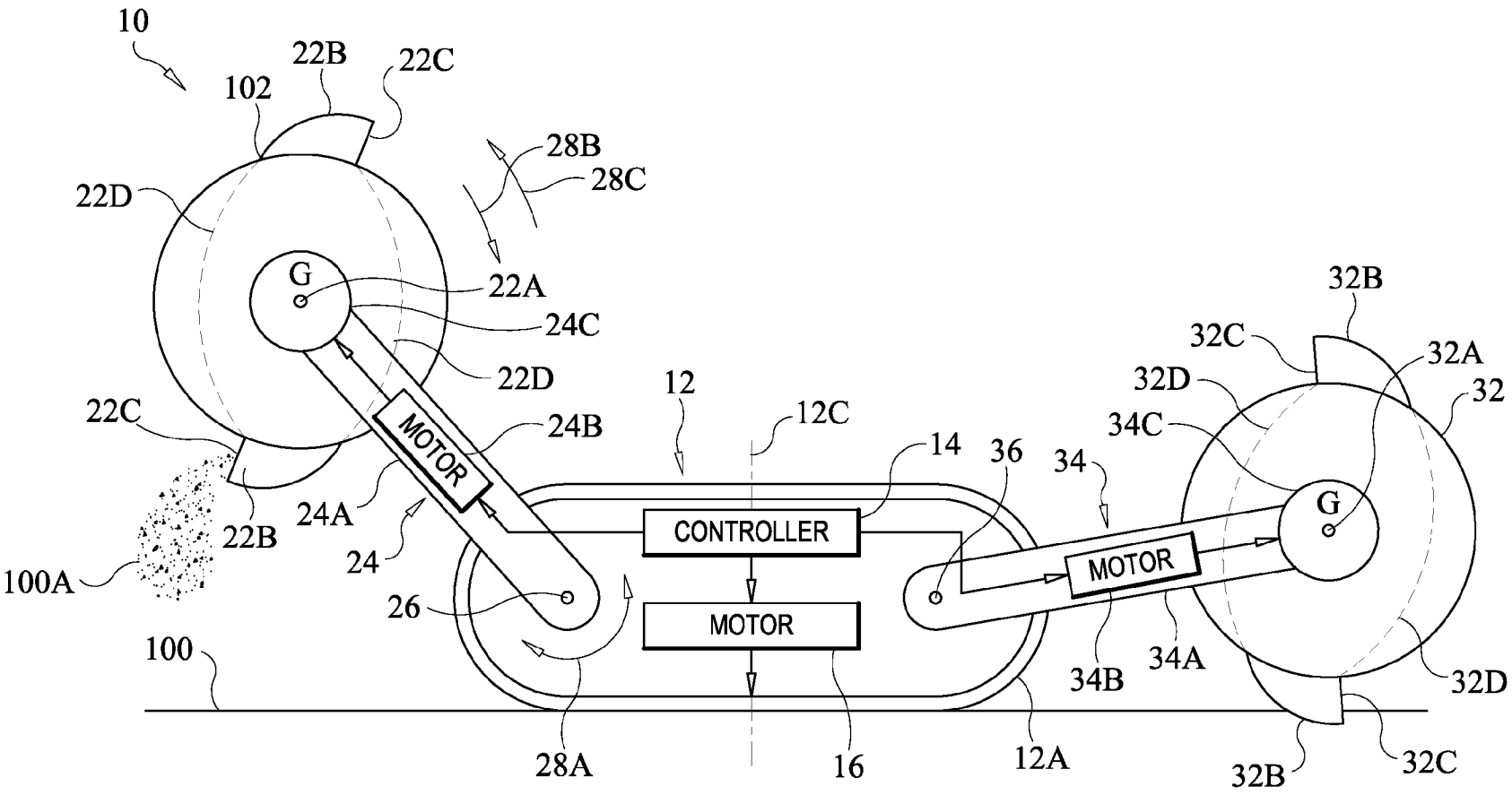
FIG. 3 is a side schematic view of the zero reaction force excavator with one of its bucket drums in a dumping position.

Referring now to the drawings, simultaneous reference will be made to FIGS. 1-3 where a zero horizontal reaction force excavator 10 in accordance with an embodiment of the present invention is shown in three of its many possible positions. Briefly, FIG. 1 illustrates excavator 10 in a travel or transport position; FIG. 2 illustrates excavator 10 in its digging or excavation position; and FIG. 3 illustrates excavator 10 with one of its bucket drums raised to a dumping position. As will be explained further below, excavator 10 generates no horizontal reaction force when it excavates (i.e., the FIG. 2 position) thereby allowing excavator 10 to be small and lightweight as is required for space transport to low-gravity environments. However, excavator 10 could also be used on Earth where its small and lightweight attributes make it an ideal candidate for use in excavating soft surfaces (e.g., sand) in which conventional heavy excavators would sink.

Excavator 10 includes a mobile chassis or vehicle 12 that could be manned or unmanned without departing from the scope of the present invention. Since excavator 10 produces zero reaction forces during excavation operations, it is well suited for space applications that will generally make use of an unmanned form of vehicle 12. For such unmanned applications, a controller 14 will generally be mounted on vehicle 12. Controller 14 could include stored programs for preplanned operations of excavator 10, could be responsive to control signals received from a remote source for "on the fly" operations of excavator 10, or could control excavator 10 using a combination of stored programs and remotely-received instructions. The choice of controller 14 and how it achieves its control functions are not limitations of the present invention.

Vehicle 12 can be any suitable structure that can navigate over a surface 100 to include a variety of surface types (e.g., smooth, rocky, hilly, hard, soft, etc.). By way of example vehicle 12 could be outfitted with one or more endless treads or tracks 12A capable of moving and navigating vehicle 12 over a surface as track 12A is driven by a motor 16 (e.g., an electric motor) controlled by controller 14. Such single or multi-track type vehicles and their navigation are well understood in the art. It is further to be understood that wheels could be used in combination with track 12A or in place thereof without departing from the scope of the present invention.

Disposed on opposing ends of vehicle 12, at mirror image locations on vehicle 12 relative to its center 12C, are bucket drum assemblies 20 and 30. Since assemblies 20 and 30 are identical in construction, a description of just assembly 20 (using reference numerals in the 20's) will be provided herein with the corresponding elements of assembly 30 being referenced by numerals in the 30's.

Bucket drum assembly 20 includes a rotatable bucket drum 22 coupled to vehicle 12 by a cantilevered assembly 24 that is pivotally coupled to vehicle 12 at pivot coupling 26. There could be another cantilevered assembly on the other side of vehicle 12 for support of bucket drum 22 without departing from the scope of the present invention. Briefly, cantilevered assembly 24 is controlled by controller 14 to pivot about coupling 26 (as indicated by two-headed direction arrow 28A) to thereby position bucket drum 22 on surface 100 (FIG. 2) at a location that is adjacent or offset from one end of vehicle 12, or off surface 100 (FIGS. 1 and 3). In general, the rotational positions of cantilevered assemblies 24 and 34 can be used to lift one or both ends of vehicle 12 off surface 100 thereby allowing excavator 10 to achieve a wide variety of robotic poses that can be demanded by terrain, application, or desired excavator function.

Cantilevered assembly 24 includes a rigid support arm 24A and mechanisms to rotate bucket drum 22 clockwise about a longitudinal axis 22A thereof as indicated by direction arrow 28B or counterclockwise as indicated by direction arrow 28C. Briefly, the mechanisms to rotate bucket drum 22 can include a motor 24B provided (or incorporated) in cantilevered assembly 24 coupled to a gear assembly ("G") 24C provided on bucket drum 22. Motor 24B could be controlled via instructions received from controller 14. Cantilevered assemblies 24 and 34 keep the respective bucket drums' longitudinal axes 22A and 32A parallel to one another throughout operation of excavator 10.

As is generally known in the art, the term "bucket drum" refers to a drum-like device/assembly having open-ended scoops formed thereon that communicate with interior region (s) within the drum. When the drum is rotated at a surface region such that each scoop scrapes/digs into the surface, scraped/dug material is deposited into the interior region(s). Accordingly, in the present invention, each bucket drum 22 includes/defines an interior volume (or volumes) accessible only via one or more open scoops 22B (two are illustrated) formed on bucket drum 22. In the illustrated embodiment, the interior region of bucket drum 22 is indicated in a general fashion by the region between dashed lines 22D. The number of scoops 22B is not a limitation of the present invention. For clarity of illustration in FIGS. 1-3, only two scoops 22B are shown. More typically, a number of such scoops will be formed on the bucket drum and distributed about the drum's rotating periphery as will be explained further below. The number, size and position of scoops 22B is duplicated for scoops 32B on bucket drum 32.

Each of scoops 22B is open at one end 22C with open end 22C designed to cut into a surface during excavation. As will be explained further below, open end 22C can be sharp, serrated, etc., to more readily dig into a surface during excavation. A sacrificial edge (not shown in FIGS. 1-3) could be attached to some or all of each open end 22C thereby allowing each scoop 22B to be repaired without replacing bucket drum 22.

When bucket drum 22 is rotated in clockwise direction 28B about its longitudinal axis 22A, each open end 22C of a scoop 22B forms the leading edge thereof. Conversely, when bucket drum 32 is rotated in counterclockwise direction 38C about its longitudinal axis 32A, each open end 32C of a scoop 32B forms the leading edge thereof. The significance of this will be explained in an operational description of excavator 10.

With continued reference to FIGS. 1-3, three basic operations of excavator 10 will be explained. In FIG. 1, both bucket drum 22 and 32 are raised off surface 100 by their respective cantilevered assemblies 24 and 34. Such positioning of bucket drums 22 and 32 allows vehicle 12 to move/navigate over surface 100. The particular distance between surface 100 and bucket drums 22 and 32 is not a limitation of the present invention. Further, cantilevered assemblies 24 and 34 could be individually controlled such that the position of bucket drum 22 above surface 100 can be different than the position of bucket drum 32 above surface 100.

FIG. 2 illustrates excavator 10 in its excavating position where bucket drums 22 and 32 are positioned on surface 100 (by their respective cantilevered assembly) and where bucket drum 22 is rotated in clockwise direction 28B while bucket drum 32 is simultaneously rotated in counterclockwise direction 38C. It is to be understood that the present invention could also be practiced by reversing the drums such that counterclockwise rotation of drum 22 and simultaneous clockwise rotation of drum 32 resulted in surface excavation. In either case, prior to such opposing directional rotation of bucket drums 22 and 32, bucket drums 22 and 32 are synchronized with respect to each other such that each scoop 22B has a mirror image scoop 32B during the opposite-direction rotation of the bucket drums. The respective longitudinal axes 22A and 32A are maintained parallel to one another throughout such opposite-direction rotation of bucket drums 22 and 32.

The above-described configuration, positioning, scoop synchronization, and counter-rotation of bucket drums 22 and 32 result in a zero horizontal reaction force (i.e., parallel to surface 100) on excavator 10. More specifically, symmetric and "equal-but-opposing" digging forces are generated as each mirror-image scoop pair 22B/32B is in engagement with surface 100. The opposing horizontal forces cancel one another out thereby resulting in a net horizontal reaction force of zero. In addition, rotation of bucket drums 22 and 32 in this fashion places respective cantilevered assembles 24 and 34 in compression (i.e., a condition that support arms 24A and 34A can better tolerate) as compared to being placed in tension.

Surface material cut/dug and scooped by each scoop 22B/32B falls into the interior volume region 22D (or regions) within the respective bucket drum 22/32. To retain material in each bucket drum during its excavation rotation, baffles (See FIG. 7) are provided in each bucket drum. In general, such baffles help retain material during excavation rotation of a bucket drum but allow the material to exit a scoop when a bucket drum is rotated in a direction opposite that of its excavation rotation. An improved baffle design for use in the present invention will be disclosed later herein.

FIG. 3 illustrates the dumping operation of excavator 10 with respect to bucket drum 22. Specifically, bucket drum 22 is raised off surface 100 by cantilevered assembly 24. Bucket drum 22 is then rotated in counterclockwise direction 28C such that each open end 22C of a scoop 22B trails the scoop during such rotation. Surface material 100A collected in the interior volume(s) 22D of bucket drum 22 exits each open end 22C as shown. Note that the position of bucket drum 32 can be on or off surface 100 during dumping of bucket drum 22.

Figure 4:
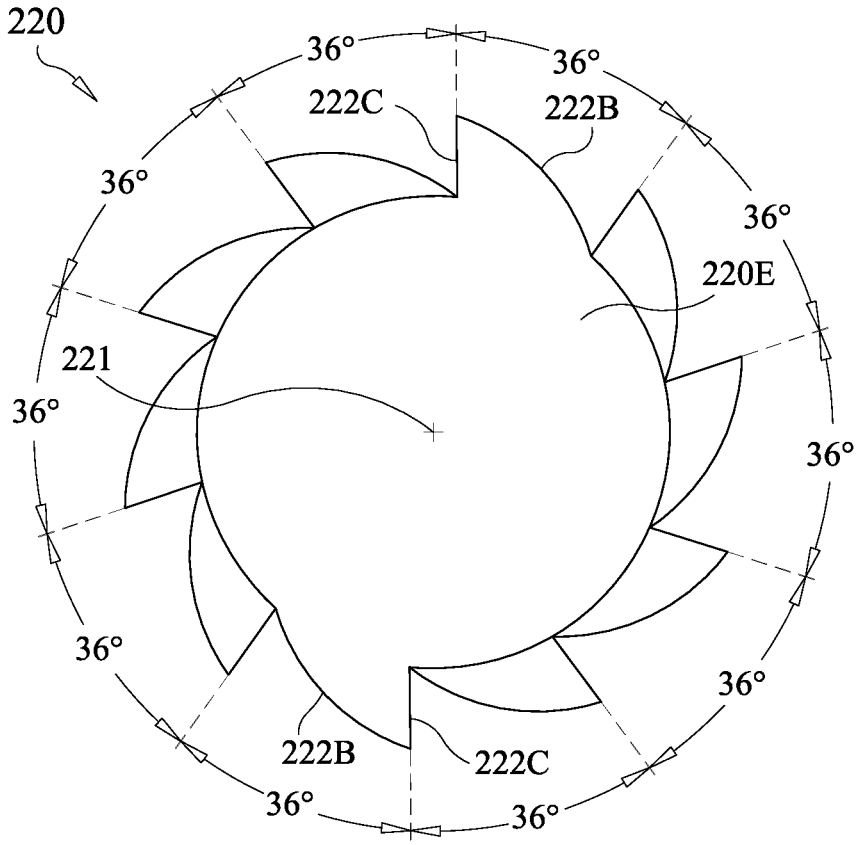
FIG. 4 is an isolated side view of a bucket drum showing the relative scoop positions in accordance with an embodiment of the present invention.
Figure 5:
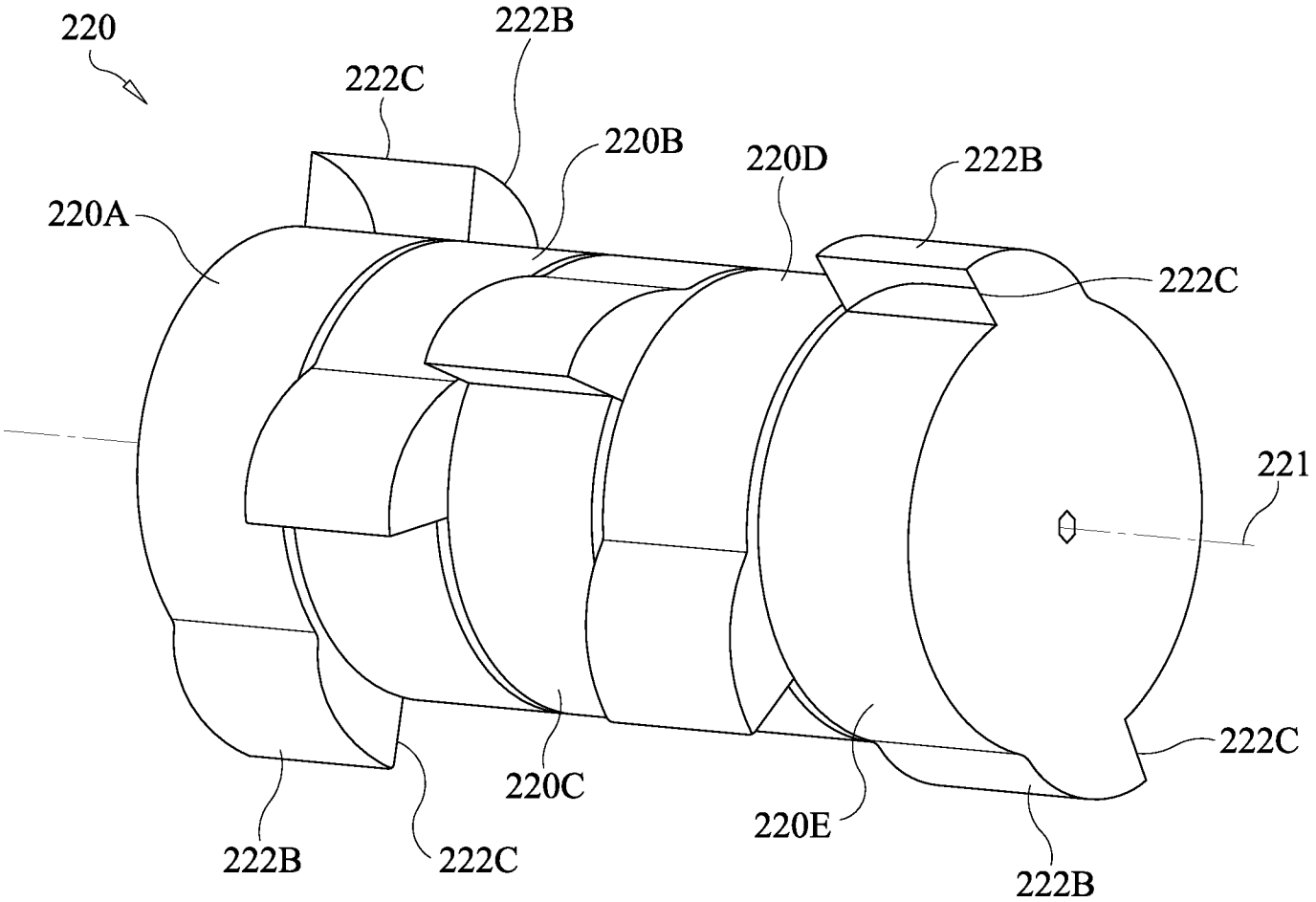
FIG. 5 is an isolated perspective view of the bucket drum shown in FIG. 4.

As mentioned above, a number of scoops can be provided on each bucket drum. For example, the number of scoops and distribution thereof about the rotating periphery of a bucket drum can be designed such that there is always at least one scoop in engagement with a surface during excavation rotation of the bucket drum. By doing this on both bucket drums, the zero horizontal reaction force will be continuous during excavation. An embodiment for achieving this is illustrated in FIGS. 4 and 5 where a bucket drum 220 having a longitudinal axis 221 is constructed from five identical and individual drums 220A-220E, each of which has two scoops 222B open at end 222C thereof. More or fewer bucket drums and/or scoops could be used without departing from the scope of the present invention. The five bucket drums are rigidly coupled to one another such that the scoops' open ends are evenly distributed about the bucket drum's rotating periphery. For the illustrated 5-drum and 10-scoop design, there is an open end 222C every 36° about the rotational periphery of bucket drum 220. Other angular spacing could be used without departing from the scope of the present invention.

Figure 6:
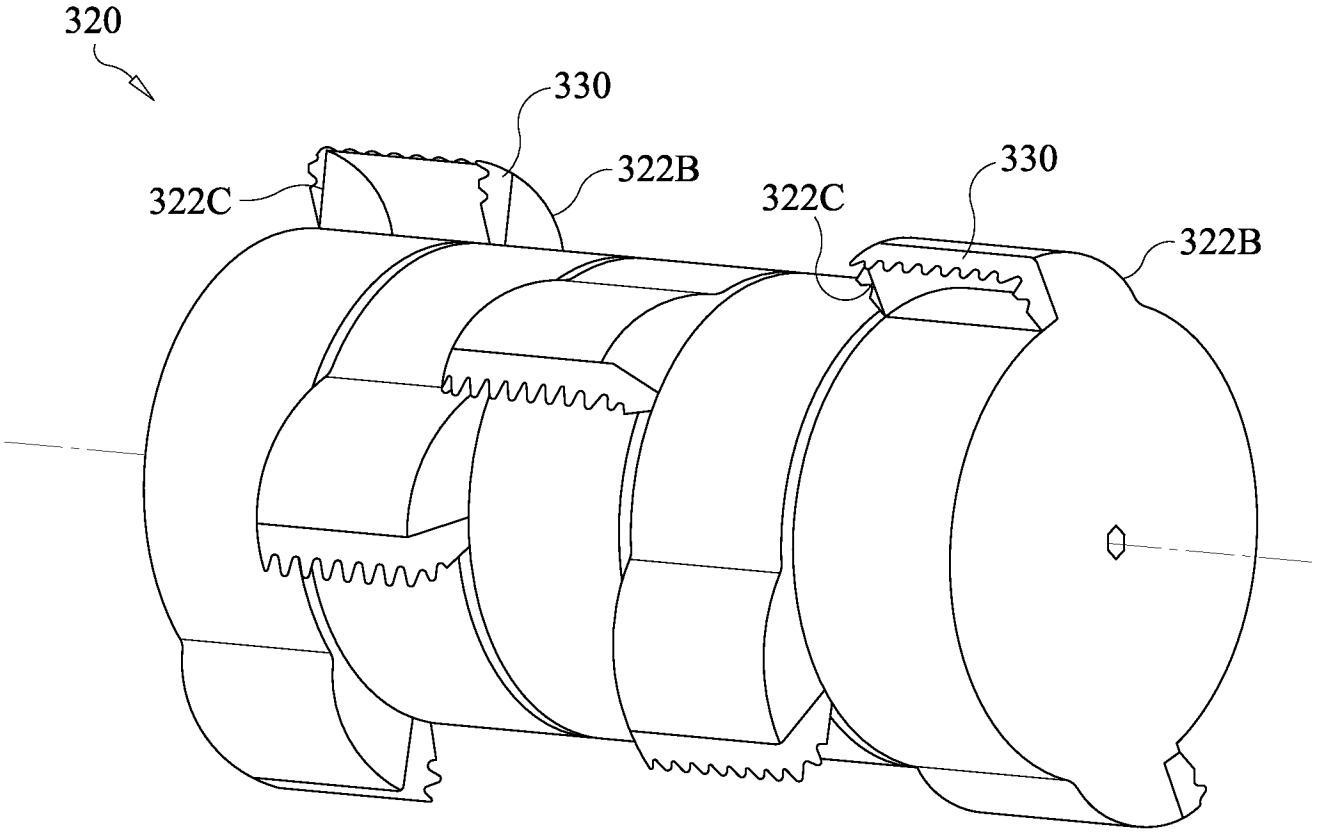
FIG. 6 is an isolated perspective view of a bucket drum with each scoop having a serrated blade attached thereto in accordance with another embodiment of the present invention.

Referring now to FIG. 6, another embodiment of a bucket drum is shown in isolation and referenced generally by numeral 320. Bucket drum 320 is similar to bucket drum 220. Additionally, each open end 322C of a scoop 322B has a serrated blade 330 attached thereto. In this way, a strong and generally expensive cutting material can be used sparingly for blades 330. Further, when a blade 330 wears out, it can simply be replaced without removing bucket drum 320 from service. Although blade 330 is shown with a fully serrated edge, it would be obvious to one skilled in the art that additional configurations (e.g., flat, partially serrated, etc.) could be attached to the scoops without departing from the scope of the present invention.

Figure 7:
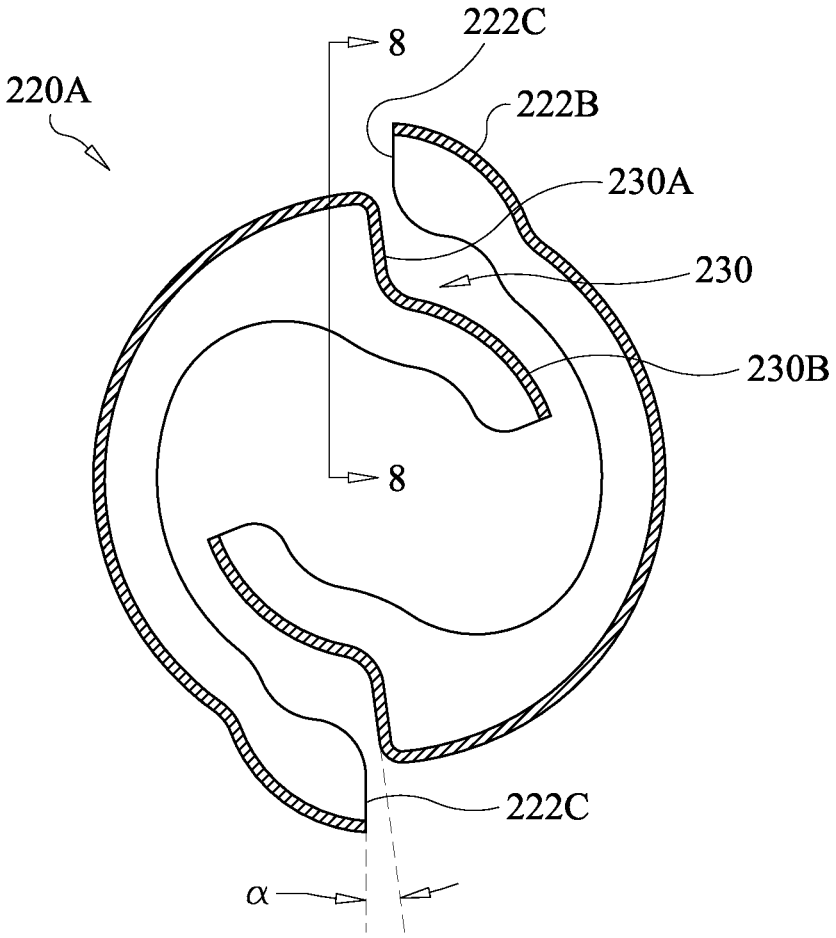
FIG. 7 is a cross-sectional view of a bucket drum shown in FIG. 5 illustrating a baffle adjacent to each scoop in accordance with an embodiment of the present invention.
Figure 8:
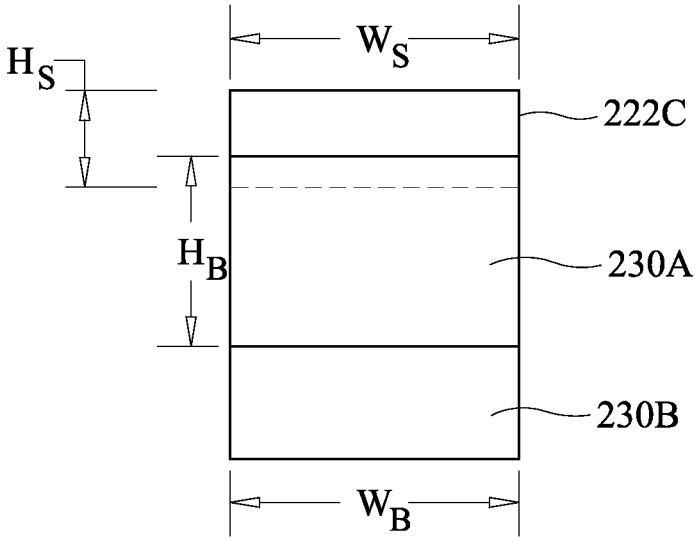
FIG. 8 is a plan view of a scoop's open end and adjacent baffle that is taken along line 8-8 in FIG. 7.

Referring now to FIG. 7, a cross-sectional view of one of the individual drums in FIG. 5 (e.g., drum 220A) is shown in order to illustrate an improved baffle design that can be incorporated into a bucket drum of the present invention. The baffle portion of drum 220A is a shaped region referenced generally by numeral 230. More specifically, baffle 230 includes a flat baffle wall 230A substantially aligned with open end 222C and a curved baffle wall 230B coupled to and extending from flat baffle wall 230A into the interior region of drum 220A. Referring additionally to FIG. 8, the width "$W_B$" of flat baffle wall 230A is the same as the width "$W_S$" of open end 222C. However, the height "$H_B$" of flat baffle wall 230A is greater than the height "$H_S$" of open end 222C. As a result, the area of flat baffle wall 230A is greater than the area defined by open end 222C. Thus, material scooped by open end 222C during excavation enters an expanded area (defined by flat baffle wall 230A) to thereby minimize the chance that drum 220A will clog during excavation. This feature is especially useful in low or zero gravity environments where clogging is more likely to occur since gravity is not available to pull material into the bucket drum as it rotates. Additionally, flat baffle wall 230A and open end 222C can have a slight angle $\alpha$ defined there between (e.g., on the order of a few degrees) to further improve material flow. Still further, all edges at open end 222C and baffle region 230 can be rounded for improved material flow. The length of curved baffle wall 230B can be adjusted for optimum material retention based on the needs of an application.

The advantages of the present invention are numerous. The present invention is directed to a completely new type of excavator capable of overcoming all of the problems associated in space environments on planetary bodies with conventional excavation apparatus. In particular, the present invention is a compact, lightweight, scalable regolith excavator that uses counter-rotating bucket drums mounted on each end of the excavator. During excavation, the excavator generates a zero horizontal reaction force due to the effective self-cancellation of the symmetrical and equal-but-opposing digging forces created by the counter-rotating bucket drums. In addition, the bucket drum design can incorporate multiple small scoops that reduce the digging forces at any given moment in the excavation operation, while being capable of hauling and dumping the regolith load without a separate storage container or dump bin. An improved baffle design reduces clogging and improves material retention.

In addition to the above-described excavation features and advantages, the opposing-end bucket drum placement can be used to manipulate the excavator in a variety of ways. For example, bucket drum positioning and selective rotation thereof can be used to help the excavator perform maneuvers such as climbing stepped surfaces, extracting itself from soft terrain, righting itself if tipped over, raising up the chassis for maintenance purposes, and achieve a wide variety of robotic poses.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. An excavator, comprising:

a mobile chassis;

a first bucket drum having a first axis of rotation, said first bucket drum coupled to said chassis, said first bucket drum having at least one open-ended first scoop formed thereon that provides access to an interior region of said first bucket drum and that is adapted to dig into a surface when said first bucket drum is placed on the surface and is rotated about said first axis of rotation in a first direction;

a second bucket drum having a second axis of rotation, said second bucket drum coupled to said chassis, said second bucket drum having at least one open-ended second scoop formed thereon that provides access to an interior region of said second bucket drum and that is adapted to dig into the surface when said second bucket drum is placed on the surface and is rotated about said second axis of rotation in a second direction that is opposite to said first direction;

said first bucket drum and said second bucket drum coupled to said chassis for positioning thereof on the surface at opposing ends of said chassis;

each said first scoop on said first bucket drum being a mirror image of one said second scoop on said second bucket drum when (i) said first bucket drum and said second bucket drum are on the surface adjacent opposing ends of said chassis, and (ii) said first bucket drum is rotated in said first direction and said second bucket drum is simultaneously rotated in said second direction.

2. An excavator, comprising:

a mobile chassis;

a first bucket drum having a first axis of rotation, said first bucket drum coupled to said chassis, said first bucket drum having at least one first scoop formed thereon that is adapted to dig into a surface when said first bucket drum is placed on the surface and is rotated about said first axis of rotation in a first direction;

a second bucket drum having a second axis of rotation, said second bucket drum coupled to said chassis, said second bucket drum having at least one second scoop formed thereon that is adapted to dig into the surface when said second bucket drum is placed on the surface and is rotated about said second axis of rotation in a second direction that is opposite to said first direction;

said first bucket drum and said second bucket drum coupled to said chassis for positioning thereof on the surface at opposing ends of said chassis;

each said first scoop on said first bucket drum being a mirror image of one said second scoop on said second bucket drum when (i) said first bucket drum and said second bucket drum are on the surface adjacent opposing ends of said chassis, and (ii) said first bucket drum is rotated in said first direction and said second bucket drum is simultaneously rotated in said second direction, wherein each said first scoop and each said second scoop has an open end, and wherein said first bucket drum and said second bucket drum include a baffle adjacent each said open end, each said baffle including a flat baffle wall substantially aligned with said open end, said flat baffle wall having an area greater than that of said open end.

3. An excavator as in claim 2 further comprising a blade attachable to an outboard edge of each said first scoop and each said second scoop.

4. An excavator as in claim 2, wherein said first bucket drum is coupled to said chassis using at least one rigid support arm pivotally coupled to said chassis for positioning said first bucket drum on the surface, said rigid support arm supporting rotation of said first bucket drum in at least said first direction.

5. An excavator as in claim 2, wherein said second bucket drum is coupled to said chassis using at least one rigid support arm pivotally coupled to said chassis for positioning said second bucket drum on the surface, said rigid support arm supporting rotation of said second bucket drum in at least said second direction.

6. An excavator as in claim 2, further comprising:

a first mechanism coupled to said first bucket drum for moving said first bucket drum in at least said first direction; and a second mechanism coupled to said second bucket drum for moving said second bucket drum in at least said second direction.

7. An excavator as in claim 2, wherein said first axis of rotation is parallel to said second axis of rotation.

8. An excavator as in claim 2, wherein said first bucket drum has a plurality of first scoops formed thereon and said second bucket drum has a plurality of second scoops formed thereon, and wherein at least one of said first scoops is in engagement with the surface throughout rotation of said first bucket drum in said first direction and at least one of said second scoops is in engagement with the surface throughout rotation of said second bucket drum in said second direction.

9. An excavator as in claim 2, wherein each said first scoop and each said second scoop terminates in a serrated edge.

10. An excavator as in claim 2, wherein an angular relationship of greater than zero degrees is defined between said flat baffle wall and said open end.

11. An excavator as in claim 2, wherein said baffle further includes a curved baffle wall coupled to said flat baffle wall.

12. An excavator, comprising:

a vehicle adapted for movement over a surface;

a first cantilevered assembly pivotally coupled on one end to said vehicle and having an outboard end rotatable to a position offset from a first end of said vehicle;

a first bucket drum having a first axis of rotation, said first bucket drum coupled to said outboard end of said first cantilevered assembly in support of said first axis of rotation, said first bucket drum having at least one open-ended first scoop formed thereon and providing access to an interior region of said first bucket drum, each said first scoop adapted to dig into a surface when said first bucket drum is placed on the surface by said first cantilevered assembly and is rotated about said first axis of rotation in a first direction wherein said first cantilevered assembly is placed in compression;

a second cantilevered assembly pivotally coupled on one end to said vehicle and having an outboard end rotatable to a position offset from a second end of said vehicle that is opposite said first end of said vehicle;

a second bucket drum having a second axis of rotation, said second bucket drum coupled to said outboard end of said second cantilevered assembly in support of said second axis of rotation, said second bucket drum having at least one open-ended second scoop formed thereon and providing access to an interior region of said second bucket drum, each said second scoop adapted to dig into the surface when said second bucket drum is placed on the surface by said second cantilevered assembly and is rotated about said second axis of rotation in a second direction that is opposite to said first direction wherein said second cantilevered assembly is placed in compression; and each said first scoop on said first bucket drum being a mirror image of one said second scoop on said second bucket drum when (i) said first bucket drum and said second bucket drum are on the surface and offset from said first end of said vehicle and said second end of said vehicle, respectively, and (ii) said first bucket drum is rotated in said first direction and said second bucket drum is simultaneously rotated in said second direction.

13. An excavator, comprising:

a vehicle adapted for movement over a surface;

a first cantilevered assembly pivotally coupled on one end to said vehicle and having an outboard end rotatable to a position offset from a first end of said vehicle;

a first bucket drum having a first axis of rotation, said first bucket drum coupled to said outboard end of said first cantilevered assembly in support of said first axis of rotation, said first bucket drum having at least one first scoop formed thereon and adapted to dig into a surface when said first bucket drum is placed on the surface by said first cantilevered assembly and is rotated about said first axis of rotation in a first direction wherein said first cantilevered assembly is placed in compression;

a second cantilevered assembly pivotally coupled on one end to said vehicle and having an outboard end rotatable to a position offset from a second end of said vehicle that is opposite said first end of said vehicle;

a second bucket drum having a second axis of rotation, said second bucket drum coupled to said outboard end of said second cantilevered assembly in support of said second axis of rotation, said second bucket drum having at least one second scoop formed thereon and adapted to dig into the surface when said second bucket drum is placed on the surface by said second cantilevered assembly and is rotated about said second axis of rotation in a second direction that is opposite to said first direction wherein said second cantilevered assembly is placed in compression; and each said first scoop on said first bucket drum being a mirror image of one said second scoop on said second bucket drum when (i) said first bucket drum and said second bucket drum are on the surface and offset from said first end of said vehicle and said second end of said vehicle, respectively, and (ii) said first bucket drum is rotated in said first direction and said second bucket drum is simultaneously rotated in said second direction, wherein each said first scoop and each said second scoop has an open end, and wherein said first bucket drum and said second bucket drum include a baffle adjacent each said open end, each said baffle including a flat baffle wall substantially aligned with said open end, said flat baffle wall having an area greater than that of said open end.

14. An excavator as in claim 13, further comprising a blade attachable to an outboard edge of each said first scoop and each said second scoop.

15. An excavator as in claim 13, further comprising:

a first mechanism coupled to said first bucket drum for moving said first bucket drum in one of said first direction and said second direction; and a second mechanism coupled to said second bucket drum for moving said second bucket drum in one of said first direction and said second direction.

16. An excavator as in claim 13, wherein said first axis of rotation is parallel to said second axis of rotation.

17. An excavator as in claim 13, wherein said first bucket drum has a plurality of first scoops formed thereon and said second bucket drum has an identical plurality of second scoops formed thereon, and wherein at least one of said first scoops is in engagement with the surface throughout rotation of said first bucket drum in said first direction and at least one of said second scoops is in engagement with the surface throughout rotation of said second bucket drum in said second direction.

18. An excavator as in claim 13, wherein each said first scoop and each said second scoop terminates in a serrated edge.

19. An excavator as in claim 13, wherein an angular relationship of greater than zero degrees is defined between said flat baffle wall and said open end.

20. An excavator as in claim 13, wherein said baffle further includes a curved baffle wall coupled to said flat baffle wall.

21. An excavator, comprising:

a vehicle adapted for movement over a surface;

a first cantilevered assembly pivotally coupled on one end to said vehicle and having an outboard end rotatable to a position offset from a first end of said vehicle;

a first bucket drum having a first axis of rotation, said first bucket drum coupled to said outboard end of said first cantilevered assembly in support of said first axis of rotation, said first bucket drum having at least one open-ended first scoop formed thereon and providing access to an interior region of said first bucket drum, each said first scoop adapted to dig into a surface when said first bucket drum is placed on the surface by said first cantilevered assembly and is rotated about said first axis of rotation in a first direction wherein said first cantilevered assembly is placed in compression;

a second cantilevered assembly pivotally coupled on one end to said vehicle and having an outboard end rotatable to a position offset from a second end of said vehicle that is opposite said first end of said vehicle;

a second bucket drum having a second axis of rotation, said second bucket drum coupled to said outboard end of said second cantilevered assembly in support of said second axis of rotation, said second bucket drum having at least one open-ended second scoop formed thereon and providing access to an interior region of said second bucket drum, each said second scoop adapted to dig into the surface when said second bucket drum is placed on the surface by said second cantilevered assembly and is rotated about said second axis of rotation in a second direction that is opposite to said first direction wherein said second cantilevered assembly is placed in compression;

said first cantilevered assembly and said second cantilevered assembly coupled to said vehicle at mirror image locations thereon relative to a center of said vehicle between said first end and said second end thereof; and each said first scoop on said first bucket drum being a mirror image of one said second scoop on said second bucket drum when (i) said first bucket drum and said second bucket drum are on the surface and offset from said first end of said vehicle and said second end of said vehicle, respectively, and (ii) said first bucket drum is rotated in said first direction and said second bucket drum is simultaneously rotated in said second direction.

22. An excavator, comprising:

a vehicle adapted for movement over a surface;

a first cantilevered assembly pivotally coupled on one end to said vehicle and having an outboard end rotatable to a position offset from a first end of said vehicle;

a first bucket drum having a first axis of rotation, said first bucket drum coupled to said outboard end of said first cantilevered assembly in support of said first axis of rotation, said first bucket drum having at least one first scoop formed thereon and adapted to dig into a surface when said first bucket drum is placed on the surface by said first cantilevered assembly and is rotated about said first axis of rotation in a first direction wherein said first cantilevered assembly is placed in compression;

a second cantilevered assembly pivotally coupled on one end to said vehicle and having an outboard end rotatable to a position offset from a second end of said vehicle that is opposite said first end of said vehicle;

a second bucket drum having a second axis of rotation, said second bucket drum coupled to said outboard end of said second cantilevered assembly in support of said second axis of rotation, said second bucket drum having at least one second scoop formed thereon and adapted to dig into the surface when said second bucket drum is placed on the surface by said second cantilevered assembly and is rotated about said second axis of rotation in a second direction that is opposite to said first direction wherein said second cantilevered assembly is placed in compression;

said first cantilevered assembly and said second cantilevered assembly coupled to said vehicle at mirror image locations thereon relative to a center of said vehicle between said first end and said second end thereof; and each said first scoop on said first bucket drum being a mirror image of one said second scoop on said second bucket drum when (i) said first bucket drum and said second bucket drum are on the surface and offset from said first end of said vehicle and said second end of said vehicle, respectively, and (ii) said first bucket drum is rotated in said first direction and said second bucket drum is simultaneously rotated in said second direction, wherein each said first scoop and each said second scoop has an open end, and wherein said first bucket drum and said second bucket drum include a baffle adjacent each said open end, each said baffle including a flat baffle wall substantially aligned with said open end, said flat baffle wall having an area greater than that of said open end.

23. An excavator as in claim 22, further comprising a blade attachable to an outboard edge of each said first scoop and each said second scoop.

24. An excavator as in claim 22, further comprising:

a first mechanism coupled to said first bucket drum for moving said first bucket drum in one of said first direction and said second direction; and a second mechanism coupled to said second bucket drum for moving said second bucket drum in one of said first direction and said second direction.

25. An excavator as in claim 22, wherein said first axis of rotation is parallel to said second axis of rotation.

26. An excavator as in claim 22, wherein said first bucket drum has a plurality of first scoops formed thereon and distributed evenly there about, said second bucket drum having an identical plurality of second scoops formed thereon and distributed evenly there about, and wherein at least one of said first scoops is in engagement with the surface throughout rotation of said first bucket drum in said first direction and at least one of said second scoops is in engagement with the surface throughout rotation of said second bucket drum in said second direction.

27. An excavator as in claim 22, wherein each said first scoop and each said second scoop terminates in a serrated edge.

28. An excavator as in claim 22, wherein an angular relationship of greater than zero degrees is defined between said flat baffle wall and said open end.

29. An excavator as in claim 22, wherein said baffle further includes a curved baffle wall coupled to said flat baffle wall.

* * * * *